US007780800B2

(12) United States Patent
Takahashi et al.

(10) Patent No.: US 7,780,800 B2
(45) Date of Patent: Aug. 24, 2010

(54) METHOD OF MANUFACTURING A BENT PIPE

(75) Inventors: Nobuaki Takahashi, Kashima (JP); Akio Yamamoto, Kashima (JP); Masahiko Hamada, Kobe (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 431 days.

(21) Appl. No.: 11/819,912

(22) Filed: Jun. 29, 2007

(65) Prior Publication Data

US 2008/0283160 A1 Nov. 20, 2008

(30) Foreign Application Priority Data

May 16, 2007 (JP) ..... 2007-130865

(51) Int. Cl.
*C21D 8/10* (2006.01)
*C21D 9/08* (2006.01)

(52) U.S. Cl. ..... 148/519; 148/593; 148/594; 148/909

(58) Field of Classification Search ..... 148/593–594, 148/654, 519–521, 909, 320, 330, 332–336, 148/590

See application file for complete search history.

(56) References Cited

FOREIGN PATENT DOCUMENTS

| | | |
|---|---|---|
| JP | 361266126 | * 11/1986 |
| JP | 07-003330 | 1/1995 |
| JP | 08-092649 | 4/1996 |
| JP | 2003-277831 | 10/2003 |
| JP | 2004-332083 | 11/2004 |
| JP | 2005-350724 | 12/2005 |

* cited by examiner

*Primary Examiner*—Deborah Yee
(74) *Attorney, Agent, or Firm*—Clark & Brody

(57) ABSTRACT

A bent pipe corresponding to at least API X100 grade and having a base metal with high strength and toughness and a weld metal with high toughness is provided. A steel plate prepared by cooling after hot rolling at a cooling rate at the central portion in the plate thickness direction of at most 5° C. per second at 700-500° C. is formed into a bend mother pipe, which is then heated to 900-1100° C. and subjected to bending, then it is cooled to a temperature of at most 300° C. at a cooling rate in the central portion of the thickness direction of at least 5° C. per second at 700-500° C., after which it is tempered at 300-500° C.

8 Claims, 4 Drawing Sheets

METHOD OF MANUFACTURING A BENT PIPE

TECHNICAL FIELD

This invention relates to a bent pipe and a method for its manufacture. More particularly, the present invention relates to an ultrahigh strength bent pipe corresponding to so-called API X100 grade or above which has a base metal with a high strength and excellent toughness and a weld metal which also has excellent toughness. This invention also relates to a method for manufacturing such a pipe.

BACKGROUND ART

Large-diameter steel pipes used to construct pipelines are primarily high-strength welded steel pipes in order to reduce their construction costs. In existing pipelines, high strength welded steel pipes of API X70 grade are mainly used, while higher strength API X80 grade welded steel pipes have been actually used in only a few instances. However, in recent years, the use of ultrahigh strength welded steel pipes which have not existed up to now such as pipes corresponding to so-called API X100 grade or API X120 grade has been investigated for use in pipelines. At present, such ultrahigh strength welded steel pipes have not been standardized as steel pipes for line pipe, but there is a high probability that they will be formally standardized in the near future.

In the following explanation, the expressions "corresponding to so-called API X100 grade" and "corresponding to so-called API X120" will be abbreviated as "X100 grade" and "X120 grade". The standards for X100 grade are expected to include a yield strength YS of at least 690 MPa, a tensile strength TS of at least 760 MPa, a yield ratio YR of at most 97.0%, and a Charpy absorbed energy at −10° C. of at least 80 J for the base metal, as well as a Charpy absorbed energy at −10° C. of at least 40 J and a shear area of at least 50% for the weld metal, and Charpy absorbed energy at −10° C. of at least 40 J and a shear area of at least 50% for the weld heat affected zone.

As the strength of welded steel pipe for line pipe reaches an ultrahigh level, it is very likely that an ultrahigh strength of at least X100 grade will also be demanded of bent pipes, which are indispensable in the construction of pipelines. However, satisfactory manufacturing techniques for ultrahigh strength bent pipes have yet to be established. This is because it is difficult to achieve a high level of strength and toughness in a bent pipe by heat treatment, which is indispensable in the manufacture of a bent pipe.

A large number of inventions relating to high strength bent pipes have been proposed in the past. See, for example, JP H07-3330 A1, JP H08-92649 A1, JP 2003-277831 A1, JP 2004-332083 A1, and JP 2005-350724 A1. These documents disclose inventions in which a high strength bent pipe is manufactured by prescribing the composition of a bend mother pipe which is a straight steel pipe before bending as well as the manufacturing conditions for the bent pipe. However, these inventions do not take into consideration the manufacturing conditions of the mother pipe or the steel plate used to form the mother pipe.

DISCLOSURE OF THE INVENTION

The present inventors found that if it is attempted to manufacture an ultrahigh strength bent pipe of at least X100 grade based on the inventions disclosed in the above-described documents, the toughness of the weld metal of the bent pipe decreases and a target toughness can not be obtained. The reason why this is so is as follows.

In order to ensure that the base metal of a welded steel pipe has a strength of at least X100 grade after bending, it is necessary for the base metal to contain a relatively large amount of alloying elements. In order to prevent fracture of weld metal in the pipe expansion stage in the manufacture of a bend mother pipe, it is necessary to increase the strength of the weld metal to higher than the strength of the base metal by achieving a so-called overmatched composition in which the content of alloying elements in the weld metal is higher than the content of alloying elements in the base metal.

Accordingly, in order to manufacture an ultrahigh strength bent pipe of at least X100 grade, the content of alloying elements in the weld metal necessarily becomes very high. As a result, the strength of the weld metal of the bent pipe considerably increases. In general, strength and toughness are inversely proportional to each other. Therefore, as the strength of the weld metal of a bent pipe increases, its toughness decreases and a target toughness can not be achieved.

The object of the present invention is to provide an ultrahigh strength bent pipe of a least X100 grade having a base metal with a high strength and excellent toughness and having a weld metal which also has excellent toughness.

In accordance with the present invention, when manufacturing an ultrahigh strength bent pipe of at least X100 grade, after hot rolling of a steel plate for use in forming a bend mother pipe, instead of performing water cooling of the steel plate as has been conventionally performed in the past, cooling is performed at a cooling rate in the central portion of the thickness direction of the plate of less than 5° C. per second in a temperature range of at most 700° C. to at least 500° C. This cooling can be performed by air cooling, for example.

As a result, the strength of the steel plate can be decreased by about 30-100 MPa compared to when it is prepared by water cooling. Accordingly, the strength of the weld metal of a bend mother pipe formed from the steel plate can also be decreased by around 30-100 MPa while maintaining an overmatched composition.

A bend mother pipe which is formed from this steel plate and which has the strength of its weld metal decreased by around 30-100 MPa is subjected to bending to form a bent pipe. The strength of the bent pipe is then increased by around 30-100 MPa above the strength of the bend mother pipe by varying the conditions for quenching and tempering which are subsequently carried out compared to conventional quenching and tempering conditions.

As a result, an ultrahigh strength bent pipe of at least X100 grade which has a base metal with a high strength and excellent toughness and a weld metal with excellent toughness can be manufactured with certainty without increasing the content of alloying elements in the weld metal.

In brief, the present invention is based on an original technical concept that by manufacturing a steel plate with a reduced strength by decreasing the cooling rate after hot rolling and then manufacturing a bend mother pipe from the steel plate and decreasing the strength of weld metal while maintaining an overmatched composition, fracture of the weld metal during pipe expansion of the bend mother pipe is prevented, and after carrying out bending of the bend mother pipe, the strength of a bent pipe is increased by varying the quenching and tempering conditions after bending, thereby making it possible to manufacture an ultrahigh strength bent pipe of at least X100 grade having a base metal with a high strength and excellent toughness and having a weld metal also having excellent toughness.

The present invention provides a method of manufacturing a bent pipe comprising preparing a steel plate by performing cooling after hot rolling at a cooling rate in the central portion in the thickness direction of the plate of less than 5° C. per second in a temperature range of at most 700° C. to at least 500° C., preparing a bend mother pipe in the form of a welded steel pipe from the steel plate, performing hot bending of the bend mother pipe, and then performing cooling at a cooling rate in the central portion of the thickness direction of at least 5° C. per second in a temperature range of at most 700° C. to at least 500° C. to manufacture a bent pipe for which the tensile strength of the base metal of the bent pipe is higher than the tensile strength of the base metal of the bend mother pipe.

The present invention also provides a method of manufacturing a bent pipe comprising preparing a steel plate by performing cooling after hot rolling at a cooling rate in the central portion in the thickness direction of the plate of less than 5° C. per second in a temperature range of at most 700° C. to at least 500° C., preparing a bend mother pipe in the form of a welded steel pipe from the steel plate, heating the bend mother pipe to a temperature range of at least 900° C. to at most 1100° C. and performing bending, then performing cooling to a temperature range of at most 300° C. at a cooling rate in the central portion of the thickness direction of at least 5° C. per second in a temperature range from at most 700° C. to at least 500° C., and then performing tempering in a temperature range from at least 300° C. to at most 500° C.

In a method of manufacturing a bent pipe according to the present invention, the bent pipe is preferably of at least API X100 grade. An example of a suitable steel composition of the base metal of the bent pipe comprises C: at least 0.03% to at most 0.12% (in this specification, unless otherwise specified, % with respect to composition means mass %), Si: at least 0.05% to at most 0.50%, Mn: at least 1.4% to at most 2.2%, S: at most 0.01%, Mo: at least 0.05% to at most 1.0%, Al: at least 0.005% to at most 0.06%, N: at most 0.008%, at least one of Cu: at least 0.05% to at most 1.0%, Ni: at least 0.05% to at most 2.0%, and Cr: at least 0.05% to at most 1.0%, at least one of Nb: at least 0.005% to at most 0.1%, V: at least 0.005% to at most 0.1%, and Ti: at least 0.005% to at most 0.03%, and a remainder of Fe and impurities, wherein the carbon equivalent Ceq given by the following Equation (1) is at least 0.45%:

$$Ceq=C+Mn/6+(Cr+Mo+V)/5+(Cu+Ni)/15 \quad (1)$$

A steel composition of the bent pipe means the steel composition of the base metal of the steel composition, which is the same as the steel composition of the steel plate from which the bend mother pipe is formed.

From another standpoint, the present invention also provides a bent pipe of at least X100 grade which is manufactured by carrying out bending of a bend mother pipe and which has a steel composition comprising C: at least 0.03% to at most 0.12%, Si: at least 0.05% to at most 0.50%, Mn: at least 1.4% to at most 2.2%, S: at most 0.01%, Mo: at least 0.05% to at most 1.0%, Al: at least 0.005% to at most 0.06%, N: at most 0.008%, at least one of Cu: at least 0.05% to at most 1.0%, Ni: at least 0.05% to at most 2.0%, and Cr: at least 0.05% to at most 1.0%, at least one of Nb: at least 0.005% to at most 0.1%, V: at least 0.005% to at most 0.1%, and Ti: at least 0.005% to at most 0.03%, and a remainder of Fe and impurities, with the carbon equivalent Ceq given by above-described Equation (1) being at least 0.45%, the bent pipe having a strength which is at least 30 MPa higher than the strength of the bend mother pipe.

The base metal of the bent pipe may further contain B: at most 0.030% and/or Ca: at most 0.005% as optional added elements.

The B content of the weld metal of the bent pipe is preferably at most 5 ppm and the O content of the weld metal is preferably at most 280 ppm.

In this specification, "bent pipe" refers to a pipe which is obtained by carrying out bending of a welded steel pipe having a base metal and a weld metal. A welded pipe of at least X100 grade means a pipe for which the yield strength YS of the base metal is at least 690 MPa and the tensile strength of the base metal is at least 760 MPa.

According to the present invention, an ultrahigh strength bent pipe of at least X100 grade having a base metal with a high strength and excellent toughness and having a weld metal which also has excellent toughness can be provided. Therefore, the present invention makes it possible to use an ultrahigh strength welded steel pipe, such as pipe of X100 grade or X120 grade, as line pipe, whereby the construction costs of pipelines can be decreased.

BEST MODE FOR CARRYING OUT THE INVENTION

Figure 1:
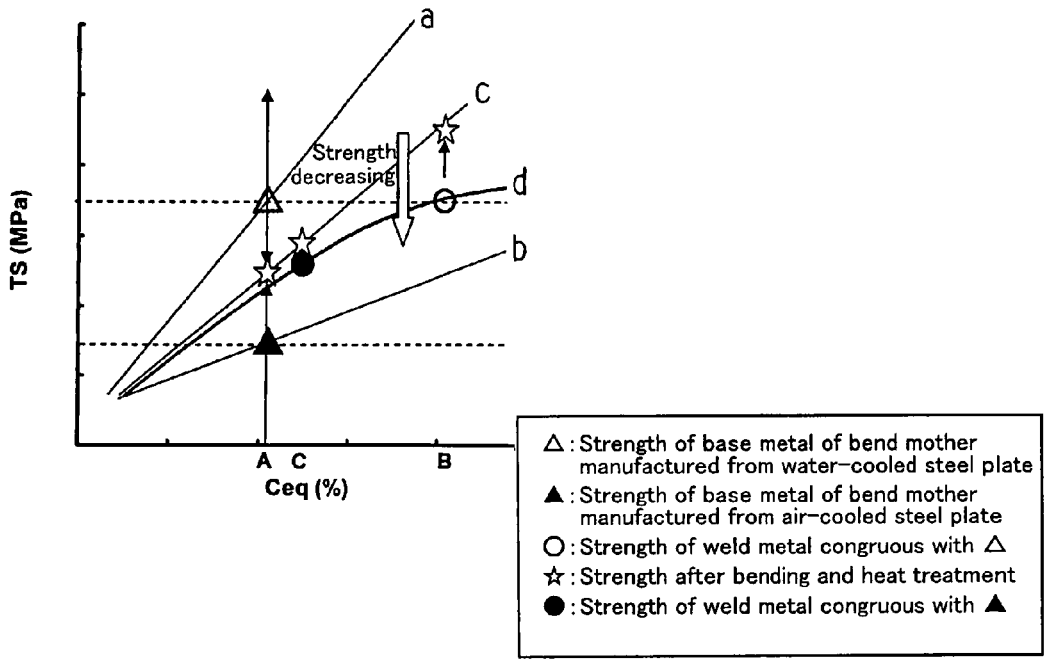
FIG. 1 is a graph quantitatively showing the relationship between the carbon equivalent Ceq (%) and the tensile strength TS (MPa) in which line "a" shows the tensile strength of a steel plate for a bend mother tube manufactured by water cooling after hot rolling at a cooling rate of 20° C. per second (comparative example), line "b" shows the tensile strength of a steel plate for a bend mother tube manufactured by air cooling at a cooling rate of less than 5° C. per second (example of the present invention), line "d" shows the tensile strength in the circumferential direction of the weld metal of bend mother pipes manufactured from these steel plates, and line "c" shows the tensile strength in the circumferential direction of the base metal and the weld metal of a bent pipe manufactured using these bend mother pipes.

Below, a preferred embodiment of the present invention will be explained in detail while referring to the accompanying drawings. First, the reasons for limiting the composition of a steel plate for use in the manufacture of a bent pipe and thus the composition of the base metal of a bend mother pipe and bent pipe according to the present invention and an embodiment of a method for its manufacture will be explained.

(C: at least 0.03% to at most 0.12%)

C is an element which is effective for increasing strength. At least 0.03% of C is contained in order to achieve a strength of at least X100 grade. However, if the C content exceeds 0.12%, toughness markedly decreases, it has an adverse effect on the mechanical properties of the base metal, and the occurrence of surface scars on slabs increases. Therefore, the C content is made at least 0.03% to at most 0.12%. From the same standpoint, the upper limit on the C content is preferably 0.08%, and the lower limit is preferably 0.04%.

(Si: at least 0.05% to at most 0.50%)

Si is contained as a deoxidizing agent for steel and for increasing the strength of steel. If the Si content is less than 0.05%, deoxidation becomes inadequate. On the other hand, if the Si content exceeds 0.50%, a large amount of martensite-austenite constituent develops in the weld heat affected zone (HAZ) leading to a marked decrease in toughness, and the mechanical properties of the bent pipe worsen. Therefore, the Si content is made at least 0.05% to at most 0.50%. From the same standpoint, the upper limit on the Si content is preferably 0.20%. The Si content is preferably determined taking the balance between the plate thickness of the steel plate for the bend mother pipe and the toughness required for HAZ into consideration.

(Mn: at least 1.4% to at most 2.2%)

Mn is a basic element for increasing the strength and toughness of steel. In the present invention, at least 1.4% of Mn is contained in order to guarantee strength. However, if the Mn content exceeds 2.2%, the toughness of the weld metal decreases, and the toughness of the base metal and the weld heat affected zone of the bent pipe also decreases. Therefore, the Mn content is made at least 1.4% to at most 2.2%. From the same standpoint, the upper limit on the Mn content is preferably 2.0% and the lower limit is preferably 1.45%.

(S: at most 0.01%)

If the S content exceeds 0.01%, the toughness of the base metal worsens. Therefore, the S content is made at most 0.01%. From the same standpoint, the upper limit on the S content is preferably 0.004%.

(Mo: at least 0.05% to at most 1.0%)

By containing at least 0.05% of Mo, a deterioration in the toughness of the base metal and weld heat affected zone of the bent pipe is suppressed and the strength of the base metal and the weld of the bent pipe is increased. However, if the Mo content exceeds 1.0%, the ease of circumferential welding in the field and the toughness of the weld heat affected zone of the bent pipe worsens. Therefore, the Mo content is made at least 0.05% to at most 1.0%. From the same standpoint, the upper limit on the Mo content is preferably 0.40% and the lower limit is preferably 0.10%.

(Al: at least 0.005% to at most 0.06%)

Like Si, Al acts as a deoxidizing agent for steel when contained in the amount of at least 0.005%. A sufficient deoxidizing effect is obtained if 0.06% of Al is contained, and if Al is contained in excess of this amount, costs merely increase. Therefore, the Al content is limited to at least 0.005% to at most 0.06%. From the same standpoint, the upper limit on the Al content is preferably 0.050% and the lower limit is preferably 0.010%.

(N: at most 0.008%)

N serves to increase the high temperature strength of steel by forming nitrides with V, Ti, or the like. However, if the N content exceeds 0.008%, it forms carbonitrides with Nb, V, or Ti and decreases the toughness of the base metal and weld heat affected zone. Therefore, the N content is made at most 0.008%. From the same standpoint, the upper limit on the N content is preferably 0.0050%.

(At least one of Cu: at least 0.05% to at most 1.0%, Ni: at least 0.05% to at most 2.0%, and Cr: at least 0.05% to at most 1.0%)

By containing at least 0.05% of Cu, Ni, or Cr, strength can be increased without greatly worsening toughness through solid-solution strengthening and a change in structure due to the effect of increasing hardenability.

However, if the Cu content exceeds 1.0%, the so-called Cu checking phenomenon which is harmful for surface scratches of slabs develops, and it becomes necessary to heat the slab at a low temperature, and manufacturing conditions are restricted. Therefore, the Cu content is made at least 0.05% to at most 1.0%.

Ni has the effect of suppressing a deterioration in toughness of the base metal and weld heat affected zone of a bent pipe. However, if the Ni content exceeds 2.0%, costs markedly increase. Therefore, the Ni content is made at least 0.05% to at most 2.0%.

If the Cr content exceeds 1.0%, the toughness of weld heat affected zone decreases. Therefore, the Cr content is made at least 0.05% to at most 1.0%.

A single one of Cu, Ni, and Cr may be added, or two or more may be added in combination.

(At least one of Nb: at least 0.005% to at most 0.1%, V: at least 0.005% to at most 0.1%, and Ti: at least 0.005% to at most 0.03%)

The addition of at least 0.005% of Nb, V, or Ti increases strength due to precipitation strengthening and an increased hardenability. It also has a great effect on increasing toughness resulting from refinement of crystal grains. In particular, Ti forms TiN and suppresses the growth of crystal grains in weld heat affected zone leading to an increase in toughness. However, if too much Ti is added, the toughness of the weld metal decreases. Therefore, the Nb content is made at least 0.005% to at most 0.1%, the V content is made at least 0.005% to at most 0.1%, and the Ti content is limited to at least 0.005% to at most 0.03%.

A single one of Nb, V, and Ti may be added, or two or more may be added in combination.

In addition to these essential elements, if necessary, one or more of the optional added elements described below may be contained in the steel composition. The optional added elements will next be explained.

(B: at most 0.030%)

B markedly increases the hardenability of steel. However, if the B content exceeds 0.0030%, weldability decreases. Therefore, when B is contained, its content is made at most 0.030%. In order to increase hardenability with certainty, the B content is preferably made at least 0.005%.

(Ca: at most 0.005%)

Ca has the effect of spheroidizing inclusions as well as preventing hydrogen induced cracking and lamination. However, the effects of Ca saturate if its content exceeds 0.005%. Therefore, when Ca is contained, its content is made at most 0.005%.

The remainder of the composition of the bent pipe in addition to the components described above is Fe and impurities.

In addition to the above-described composition, the carbon equivalent Ceq of a steel plate for a bend mother pipe, the base metal of the bend mother pipe, and the base metal of a bent pipe, and the B content and O content of the weld metal of a bend mother pipe and a bent pipe are each important for manufacturing a bent pipe of high strength and high toughness such as X100 grade or above. These significance of these parameters will next be explained.

(Carbon equivalent Ceq: at least 0.45%)

In order to ensure that a bent pipe has an ultrahigh strength of at least X100 grade, the carbon equivalent Ceq is made at least 0.45%. From the same standpoint, the carbon equivalent Ceq is preferably at least 0.48%.

The carbon equivalent Ceq is given by the following equation:

$$Ceq=C+Mn/6+(Cr+Mo+V)/5+(Cu+Ni)/15.$$

(B content: at most 5 ppm (or boron free), O content: at most 280 ppm for the weld metal)

Lowering the strength of a bend mother pipe has an effect on increasing the toughness of the weld metal. Factors which metallurgically influence an increase in the toughness of the weld metal are the B content and the O content of the weld metal of the bend mother pipe. The B content and the O content of the weld metal both depend upon the flux components at the time of welding.

In order to obtain a target toughness, the O content of the weld metal is preferably made as low as possible. For example, it is preferably at most 280 ppm. The O content of weld metal can be decreased by using a highly basic flux at the time of welding.

The B content of the seam weld metal of a straight UOE steel pipe up to X70 grade is generally made at least 10 ppm to at most 30 ppm in order to prevent a decrease in toughness. As a result, precipitation of grain boundary ferrite is suppressed, and a uniform acicular ferrite structure can be obtained to prevent a decrease in toughness.

On the contrary, in the case of an ultrahigh strength UOE steel pipe exceeding X70 grade, it is desirable that the weld metal of the pipe do not contain B in order to increase toughness. This is because the precipitation of grain boundary ferrite can be adequately prevented due to an increase in hardenability even if B is not contained, and if B is contained, the formation of lath structure is promoted thereby decreasing toughness.

Next, an embodiment of a method of manufacturing a bent pipe will be explained.

In this embodiment, hot rolling is carried out on a steel slab having the above-described steel composition by a conventional method. After hot rolling, a steel plate for forming a bend mother pipe is manufactured by cooling at a cooling rate in the central portion in the thickness direction of the plate of less than 5° C. per second in the temperature range from at most 700° C. to at least 500° C.

In a conventional method of manufacturing an ultrahigh strength bent pipe of at least X100 grade, a material for rolling containing a large amount of alloying elements was used, and water cooling was performed after the completion of hot rolling so that hardening at a high cooling rate of at least 20° C. per second, for example, was performed to prepare an ultrahigh strength steel plate for use in forming a bend mother pipe. This steel plate was then used to manufacture a bend mother pipe in the form of a welded steel pipe. In order to prevent fracture of the weld metal in the pipe expansion step of pipe manufacture, the strength of the weld metal was made higher than the strength of the base metal which had been given an ultrahigh strength. Therefore, if an ultrahigh strength bent pipe of at least X100 grade was manufactured by a conventional manufacturing method, the strength of the weld metal of the bent pipe was excessively increased, and at the same time, the toughness of the weld metal of the bent pipe unavoidably decreased.

In contrast, in this embodiment, a steel plate for manufacturing a bend mother pipe is manufactured by cooling after hot rolling at a cooling rate in the central portion of the thickness direction of the plate of less than 5° C. per second in a temperature range from at most 700° C. to at least 500° C. without particularly increasing the content of alloying elements in the steel plate. As a result, the strength of the steel plate for forming a bend mother pipe can be decreased by approximately 30 to 100 MPa compared to the case when water cooling is performed after hot rolling, and the strength of the weld metal of the bend mother pipe can also be decreased by approximately 30 to 100 MPa compared to when water cooling is performed after hot rolling. Accordingly, the toughness of the weld metal of a bent pipe can be adequately maintained.

In this embodiment, a bend mother pipe in the form of a welded steel pipe can be manufactured by a conventional method such as the UOE pipe forming method from a steel plate manufactured in this method. It is not necessary to limit the pipe forming method to a specific method. Such a pipe forming method is well known to those skilled in the art, so an explanation thereof will be omitted.

In this embodiment of the present invention, at the time of manufacturing a bend mother pipe in the above-described manner, the strength of the bend mother pipe is approximately 30 to 100 MPa lower than the target final strength of the bent pipe, such as at least X100 grade. However, as stated below, by optimizing the conditions for quenching (hardening) and tempering which are carried out after bending, the strength of the bent pipe is increased by approximately 30-100 MPa above the strength of the bend mother pipe, so an ultrahigh strength bent pipe of at least X100 grade can be manufactured.

In this embodiment, a bend mother pipe which is manufactured in the above-described manner is heated to a temperature range from at least 900° C. to at most 1100° C. and then subjected to bending. It is then cooled to a temperature range of at most 300° C. at a cooling rate in the central portion in the thickness direction of at least 5° C. per second in the temperature range from at most 700° C. to at least 500° C., and then it is tempered in a temperature range from at least 300° C. to at most 500° C., i.e., it is aged in a temperature range of at least 300° C. to at most 500° C.

Bending is carried out in a conventional manner such that the weld metal of the bend mother pipe is located on the inner side of the bend portion.

In this embodiment, in order to prevent a decrease in toughness of the weld metal in a bent pipe as its strength increases and particularly in the case of an ultrahigh strength of at least X100 grade, a bend mother pipe is manufactured while employing cooling conditions after hot rolling of a steel plate for forming the bend mother pipe which are different from conventional cooling conditions, and the bent pipe is manufactured with the hardening and tempering conditions after bending which differ from conventional hardening and tempering conditions.

Heat treatment after bending comprises heating from at least 900° C. to at most 1100° C., cooling to at most 300° C. such as to room temperature at a cooling rate in the central portion of the plate thickness direction of at least 5° C. per second in a temperature range from at most 700° C. to at least 500° C., and then tempering at a low temperature of at least 300° C. to at most 500° C.

In a low temperature range from at least 300° C. to at most 500° C., dislocations are not able to move so freely. Accordingly, dislocations adequately undergo pinning just by cementite. Therefore, according to this embodiment, precipitates for exhibiting a pinning effect on dislocations are not necessary, so the yield strength can be increased without a significant decrease in tensile strength.

According to this embodiment, a bend mother pipe having a decreased strength is prepared by using a suitably selected composition, and strengthening of a bent pipe to an ultrahigh strength level is achieved by carrying out suitable heat treatment after bending. Therefore, according to this embodiment, an ultrahigh strength bent pipe of at least X100 grade having a base metal with high strength and excellent toughness and weld metal also having excellent toughness can be manufactured without an increase in costs due to addition of alloying elements in large amounts.

This embodiment is different from a conventional method in which emphasis is placed on achieving a desired high strength and toughness after bending by performing hardening without subsequent tempering. It is also different from a conventional method in which tempering is carried out at a high temperature in order to achieve a high strength and high toughness after bending. In this embodiment, a bend mother pipe is manufactured from a steel plate which is manufactured by cooling after hot rolling at a cooling rate in the central portion in the plate thickness direction of less than 5° C. per second in a temperature range from at most 700° C. to at least 500° C. Therefore, the strength of the steel plate can be decreased, and at the same time, the strength of the weld metal of the bend mother pipe can be decreased.

Accordingly, with this embodiment, the toughness of the weld metal, which decreases due to an unavoidable increase in the strength of the base metal of a bent pipe formed from a steel plate manufactured by water cooling after hot rolling, can be greatly increased. Therefore, the problem of a decrease in the toughness of weld metal, which is a technical problem of an ultrahigh strength bent pipe of at least X100 grade, can be essentially solved.

FIG. 1 is a graph quantitatively showing the relationship between the carbon equivalent Ceq (%) and the tensile strength TS (MPa) in which line "a" shows the tensile strength of a steel plate for use in bend mother tube production manufactured by water cooling after hot rolling at a cooling rate of 20° C. per second (comparative example), line "b" shows the tensile strength of a steel plate for use in bend mother tube production manufactured by air cooling at a cooling rate of less than 5° C. per second (working example), line "d" shows the tensile strength of the weld metal of bend mother pipes manufactured from these steel plates, and line "c" shows the tensile strength in the circumferential direction of the base metal and the weld metal of a bent pipe manufactured using these bend mother pipes.

Based on the graph in this figure, an explanation will be given of an example of manufacturing an ultrahigh strength bent pipe which satisfies X100 grade. When a composition of the base metal of the steel plate having a Ceq of A is initially selected, the strength of the base metal of the bend mother pipe formed from the plate becomes the value shown by the hollow triangle when the plate is formed using water cooling (such as at a cooling rate of 20° C. per second), and it becomes the value shown by the solid triangle when the steel plate is manufactured using air cooling (at a cooling rate of less than 5° C. per second). The strength of the weld metal needs to be higher than the strength of the base metal of the bend mother pipe in order to prevent fracture during the manufacture of the bend mother pipe. The strength of the weld metal of the bend mother pipe when equals the strength of the base metal shown by the hollow triangle on line d is shown by the hollow circle. The composition having this strength has a Ceq of B.

In contrast, the weld metal of the bend mother pipe matching the solid triangle is shown by the solid circle if the strength of the bent pipe shown by line d is taken into consideration and its composition is that having a Ceq of C.

From the graph shown in FIG. 1, it can be seen that the strength level of a steel plate used to form a bend mother pipe greatly varies in accordance with differences in cooling conditions after hot rolling of the steel plate and that the strength level and composition (Ceq) of the weld metal which are suitable for the base metal also greatly differ. In general, strength and toughness are inversely proportional, so it can be seen that the toughness of the weld metal of a bent pipe having a composition of a Ceq of B is considerably lower than the toughness of the weld metal of a bent pipe having a composition of a Ceq of C.

Thus, according to the present invention, the content of alloying elements in the weld metal of a bend mother pipe can be greatly decreased from a composition having a Ceq of B to a composition having a Ceq of C, so the toughness of the weld metal of a bent pipe can be greatly increased.

According to this embodiment, an ultrahigh strength bent pipe of at least X100 grade having a base metal with a high strength and excellent toughness and a weld metal also with excellent toughness can be manufactured. Specifically, a bent pipe of at least X100 grade manufactured according to this embodiment has a yield strength YS of the base metal of at least 690 MPa, a tensile strength of the base metal of at least 760 MPa, a yield ratio of the base metal of at most 97.0%, Charpy absorbed energy of the base metal at −10° C. of at least 80 J, Charpy absorbed energy of the weld metal at −10° C. of at least 40 J, a shear area of the weld metal of at least 50%, Charpy absorbed energy of the weld heat affected zone at −10° C. of at least 40 J, and a shear area of the weld heat affected zone of at least 50%.

In order to ascertain the effects of this embodiment, the below-described straight pipe heating test was carried out. A straight pipe heating test was selected since if a bent pipe is actually manufactured and tested, the costs required for testing become very high. In this test, the mechanical properties of a straight pipe manufactured by the same manufacturing process as is used for an actual bent pipe with only the bending step omitted are evaluated. A straight pipe heating test can evaluate the effectiveness of the heating conditions in the manufacturing steps of a bent pipe relatively inexpensively and easily.

A straight pipe heating test was carried out by using a bend mother pipe formed from a steel plate obtained by water cooling after hot rolling at a cooling rate of 25° C. per second, and after hardening (quenching) without bending, the pipe is either not tempered or else it is tempered at a tempering temperature of 350, 400, or 450° C.

The bend mother pipe used in the straight pipe heating test was a UOE steel pipe with an outer diameter of 914 mm and a wall thickness of 16 mm. Table 1 shows the composition of the base metal and the weld metal of the bend mother pipe. Table 2 shows various mechanical properties of the base metal, the weld metal, and the weld heat affected zone of the bend mother pipe.

TABLE 1

| C | Si | Mn | S | Mo | Al | N | Cu | Ni | Cr | Nb | V | Ti | Ceq |
|---|---|---|---|---|---|---|---|---|---|---|---|---|---|
| 0.04 | 0.05 | 1.50 | 0.0004 | 0.38 | 0.020 | 0.0040 | 0.30 | 0.60 | 0.30 | 0.020 | 0.035 | 0.016 | 0.51 |

TABLE 2

| Base metal | | | | Weld metal | | Weld heat affected zone | |
|---|---|---|---|---|---|---|---|
| Tensile test | | | Charpy test | Charpy test | | Charpy test | |
| YS (MPa) | TS (MPa) | YR (%) | energy (J) | energy (J) | SA (%) | energy (J) | SA (%) |
| 986 | 1022 | 96.5 | 258 | 88 | 82 | 151 | 77 |

SA = Shear Area (percent shear fracture).
Charpy test temperature = −10° C.

In the straight pipe heating test, a steel plate for use in manufacturing a bend mother pipe was prepared by water cooling after hot rolling at a cooling rate of 25° C. per second. The weld metal had a high content of alloying elements in accordance with the strength of the steel plate (see Table 1). As a result, the strength of the weld metal of the bend mother pipe became extremely high.

The bend mother pipe was heated to 1030° C., it was then water cooled to a temperature of at most 300° C. at a cooling rate measured in the central portion of the thickness direction of 16° C. per second and subsequently allowed to cool to room temperature. Heat treatment was then carried out under the tempering conditions shown in Table 3. The holding time in the tempering treatment was based on a rate of one hour per one inch (25.4 mm) of thickness. As the wall thickness of the bend mother pipe was 16 mm, the holding time in this test was approximately 38 minutes.

Table 3 shows the results (YS, TS, and YR) of a tensile test of the base metal of the resulting straight pipe, the absorbed energy in a Charpy impact test of the base metal, the absorbed energy and SA (shear area) in a Charpy impact test of the weld metal, and the absorbed energy and SA (shear area) in a Charpy impact test of the weld heat affected zone. The tensile test was carried out using a plate-shaped tensile test specimen specified by API, and the Charpy impact test was carried out at a test temperature of −10° C. using a 10 mm×10 mm Charpy test piece with a 2-mm V-notch.

Figure 4:
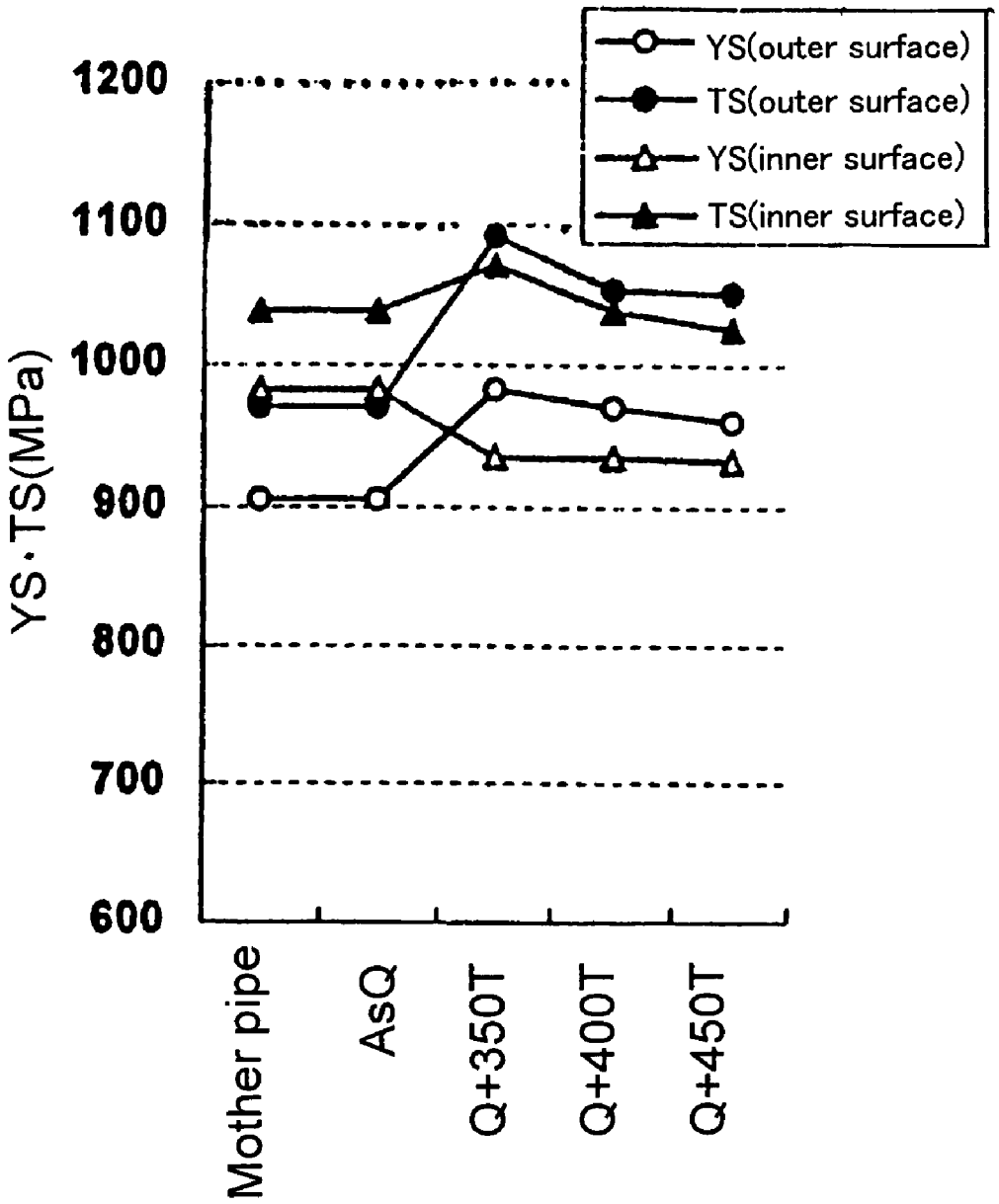
FIG. 4 is a graph showing the relationship between the tempering conditions (no tempering (As-Q), tempering at 350° C., tempering at 400° C., or tempering at 450° C.) and the strength (YS, TS) of the inner surface and the outer surface of the weld metal.

FIG. 4 is a graph showing the relationship between the tempering conditions (bend mother pipe, no tempering (AsQ), tempering at 350° C., tempering at 400° C., or tempering at 450° C.) and the strength (0.5% YS, TS) of the inner surface and outer surface of the weld metal.

Figure 2:
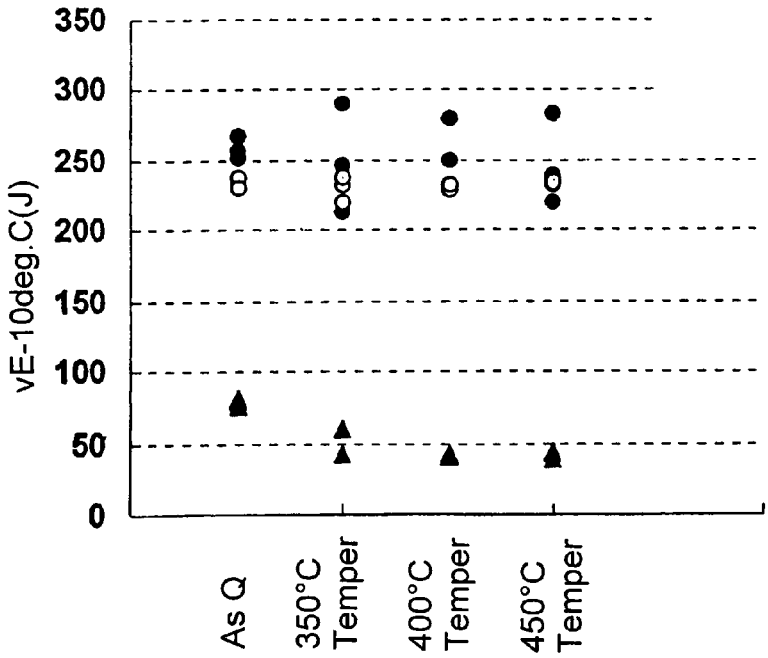
FIG. 2 is a graph showing the relationship between the tempering conditions (no tempering (As-Q), tempering at 350° C., tempering at 400° C., or tempering at 450° C.) and the absorbed energy vE −10° C. (J) in a Charpy impact test.
Figure 3:
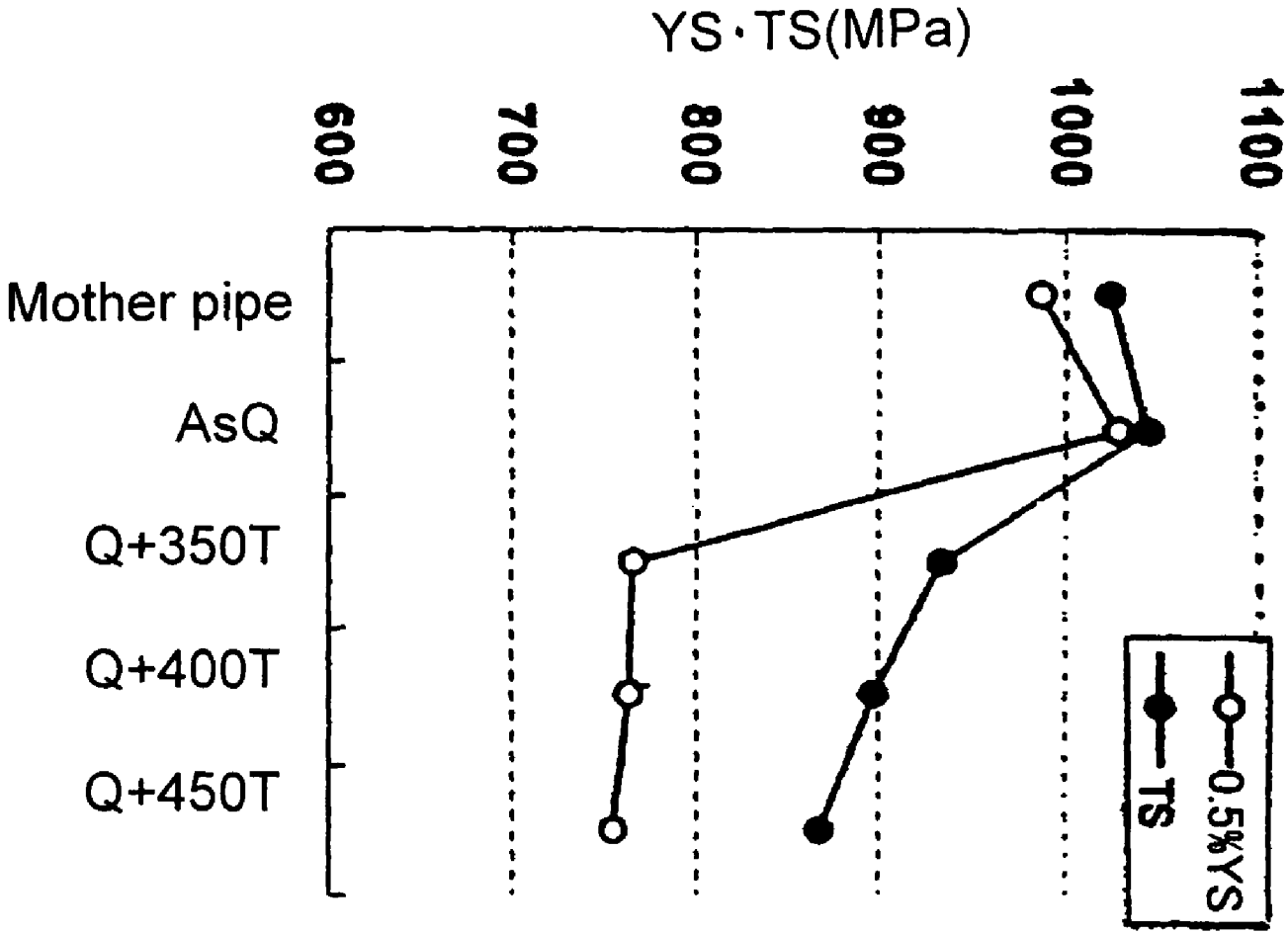
FIG. 3 is a graph showing the relationship between the tempering conditions (no tempering (As-Q), tempering at 350° C., tempering at 400° C., or tempering at 450° C.) and the strength of the base metal (0.5% YS, TS).

From the graphs of FIGS. 2-4, it can be seen that the tensile strength and toughness of the base metal of the straight pipe were both good. However, the toughness of the weld metal was extremely poor with absorbed energy vE −10° C. of around 50 J. The toughness of the weld metal was poor because the strength of the base metal was around 900 MPa, whereas the strength of the weld metal was a high value of around 1050 MPa.

It can be envisaged that reducing the strength of the weld metal of a bent pipe by decreasing the content of alloying elements in the weld metal is effective for achieving the toughness of the weld metal for an ultrahigh strength bent pipe of at least X100 grade. However, if the content of alloying elements in the weld metal is simply decreased, the composition of the weld metal becomes an undermatched one in which the strength of the weld metal falls below the strength of the base metal, and the weld metal fractures during the pipe expansion step at the time of manufacture of a bend mother pipe. In contrast, in this embodiment, the strength of the steel plate which becomes the base metal of the bend mother pipe is decreased, so the content of alloying elements in the weld metal can be decreased while maintaining the weld metal of the bend mother pipe with an overmatched composition.

TABLE 3

| | Tempering | Base metal | | | | Weld metal | | Weld heat affected zone | |
|---|---|---|---|---|---|---|---|---|---|
| | | Tensile test | | | Charpy test | Charpy test | | Charpy test | |
| | temperature (° C.) | YS (MPa) | TS (MPa) | YR (%) | energy (J) | energy (J) | SA (%) | energy (J) | SA (%) |
| | As quenched | 1026 | 1043 | 98.4 | 258 | 79 | 81 | 214 | 98 |
| 1 | 350 | 767 | 934 | 82.1 | 250 | 48 | 58 | 234 | 96 |
| 2 | 400 | 764 | 896 | 85.2 | 269 | 41 | 26 | 232 | 100 |
| 3 | 450 | 756 | 866 | 87.2 | 248 | 41 | 22 | 242 | 100 |
| | Target value for X100 grade | ≧690 | ≧760 | ≦97.0 | ≧80 | ≧40 | ≧50 | ≧40 | ≧50 |

FIG. 2 is a graph showing the relationship between tempering conditions (no tempering (AsQ), tempering at 350° C., tempering at 400° C., or tempering at 450° C.) and the absorbed energy vE −10° C. (J) in a Charpy impact test. In the graph of FIG. 2, the solid circles indicate the base metal, the solid triangles indicate the weld metal, and the hollow circles indicate the weld heat affected zone.

FIG. 3 is a graph showing the relationship between the tempering conditions (bend mother pipe, no tempering (AsQ), tempering at 350° C., tempering at 400° C., or tempering at 450° C.) and the strength of the base metal (0.5% YS, TS).

Figure 5:
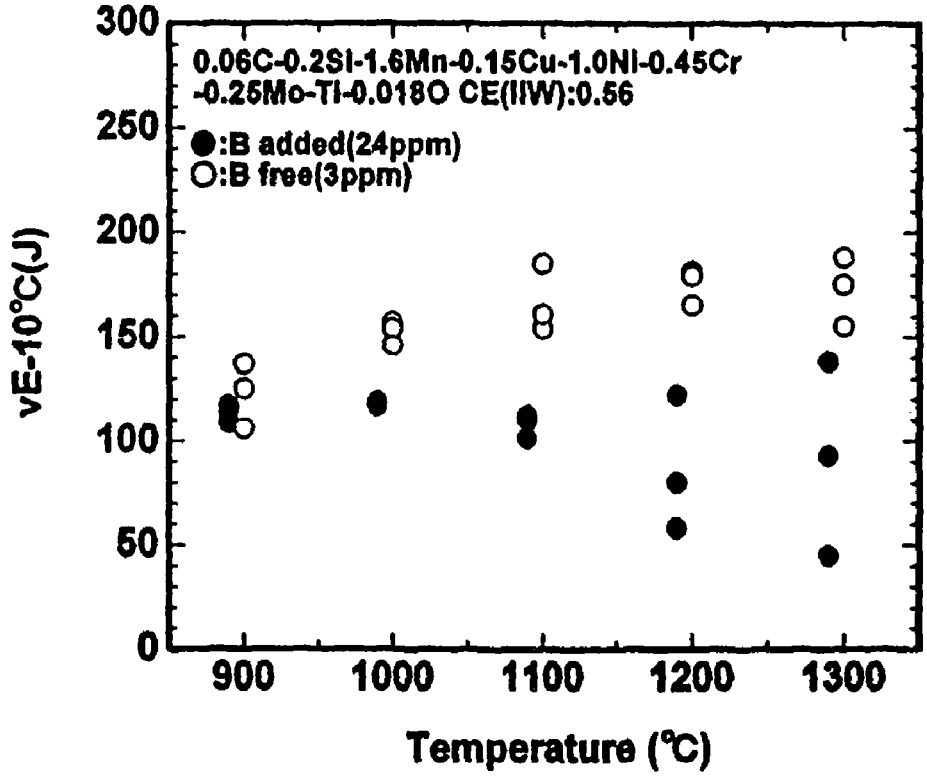
FIG. 5 is a graph showing the effect of the quenching temperature and the B content of the weld metal (24 ppm, 3 ppm) on the toughness (absorbed energy in a Charpy impact test at −10° C.) after heat treatment of weld metal having a composition in which the carbon equivalent Ceq is 0.40%.

FIG. 5 is a graph showing the effect of the quenching temperature and the B content of the weld metal (24 ppm or 3 ppm) on the toughness (absorbed energy in a Charpy impact test at −10° C.) after heat treatment of weld metal with a composition of C: 0.06%, Si: 0.2%, Mn: 1.6%, Cu: 0.15%, Ni: 1.0%, Cr: 0.45%, Mo: 0.25%, Ti: 0.012%, O: 0.018%, CE (IIW): 0.56%, and a remainder of Fe and impurities and having a carbon equivalent Ceq of 0.40%.

As stated above, in order to increase the toughness of the weld metal of a bent pipe, it is most effective to decrease the strength of the weld metal. As shown in the graph of FIG. 5, however, the toughness of weld metal can also be increased by decreasing the B content of the weld metal to at most 5 ppm. Therefore, it is also preferable to reduce the B content of the weld metal to at most 5 ppm.

In general, a boron-containing flux is used in seam welding with a bent pipe of at most X70 grade. However, with an ultrahigh strength bent pipe of at least X100 grade, it is preferable to use a flux containing as little B as possible in order to increase the toughness of the weld metal. This is because the precipitation of ferrite along grain boundaries can be adequately prevented due to the increase in hardenability even if B is not contained, and if B is contained, the formation of lath structure ends up being promoted and toughness decreases.

EXAMPLE 1

The present invention will be explained more specifically while referring to examples.

Steel plates having the steel composition, carbon equivalent Ceq, and weld crack parameter Pcm shown in Table 4 were manufactured by hot rolling a steel slab followed by air cooling or water cooling. The resulting steel plates were used to manufacture bend mother pipes in the form of UOE steel pipes by the UOE manufacturing method.

The bend mother pipes were heated so that the temperature in the central portion of the thickness direction became the heating temperature shown in Table 4, and then bending was performed. After bending, cooling was immediately performed to a temperature range of at most 300° C. at the bent pipe cooling rate shown in Table 4. Tempering was then performed at the bent pipe tempering temperature shown in Table 4 to manufacture a bent pipe with an outer diameter of 914.4 mm, a wall thickness of 16 mm, and an overall length of 12,000 mm.

TABLE 4

| No. | Plate cooling method | Composition of base metal C | Si | Mn | S | Cu | Ni (wt %) | Cr | Mo | Nb | V | Ti |
|---|---|---|---|---|---|---|---|---|---|---|---|---|
| 1 | air | 0.04 | 0.05 | 1.52 | 0.0004 | 0.31 | 0.60 | 0.30 | 0.30 | 0.015 | 0.025 | 0.015 |
| 2 | water | 0.04 | 0.05 | 1.52 | 0.0004 | 0.31 | 0.60 | 0.30 | 0.30 | 0.015 | 0.025 | 0.015 |
| 3 | air | 0.08 | 0.05 | 1.85 | 0.0012 | 0.30 | 0.30 | <0.05 | 0.30 | 0.020 | <0.01 | 0.015 |
| 4 | water | 0.08 | 0.05 | 1.85 | 0.0012 | 0.30 | 0.30 | <0.05 | 0.30 | 0.020 | <0.01 | 0.015 |
| 5 | water | 0.08 | 0.21 | 1.80 | 0.0015 | — | — | — | — | — | — | — |
| 6 | air | 0.07 | 0.05 | 1.91 | 0.0011 | 0.40 | 0.50 | <0.05 | <0.05 | 0.013 | <0.01 | 0.012 |
| 7 | air | 0.04 | 0.05 | 1.52 | 0.0004 | 0.31 | 0.60 | 0.30 | 0.30 | 0.015 | 0.025 | 0.015 |
| 8 | air | 0.09 | 0.20 | 2.01 | 0.0014 | — | — | 0.30 | 0.15 | 0.020 | 0.025 | 0.012 |
| 9 | air | 0.04 | 0.05 | 1.52 | 0.0004 | 0.31 | 0.60 | 0.30 | 0.30 | — | — | 0.015 |
| 10 | air | 0.04 | 0.05 | 1.50 | 0.0004 | 0.30 | 0.50 | 0.30 | 0.30 | 0.015 | 0.025 | 0.015 |
| 11 | air | 0.04 | 0.05 | 1.52 | 0.0004 | 0.31 | 0.60 | 0.30 | 0.30 | 0.015 | 0.025 | 0.015 |
| 12 | air | 0.04 | 0.05 | 1.52 | 0.0004 | 0.31 | 0.60 | 0.30 | 0.30 | 0.015 | 0.025 | 0.015 |
| 13 | air | 0.04 | 0.05 | 1.52 | 0.0004 | 0.31 | 0.60 | 0.30 | 0.30 | 0.015 | 0.025 | 0.015 |

| No. | Composition of base metal Ca | B | Al (wt %) | N | Ceq | Pcm | Cooling rate of plate (½t) (° C./sec) | Hating temp. of bent pipe (° C.) | Cooling rate of bent pipe (½t) (° C./sec) | Tempering temp of bent pipe (° C.) |
|---|---|---|---|---|---|---|---|---|---|---|
| 1 | — | 0.0011 | 0.025 | 0.0024 | 0.51 | 0.20 | 3 | 1030 | 16 | 400 |
| 2 | — | 0.0011 | 0.030 | 0.0032 | 0.51 | 0.20 | 35 | 1030 | 16 | 400 |
| 3 | — | — | 0.020 | 0.0039 | 0.50 | 0.20 | 2 | 1030 | 16 | 400 |
| 4 | — | — | 0.022 | 0.0033 | 0.50 | 0.20 | 20 | 1030 | 16 | 400 |
| 5 | — | — | 0.032 | 0.0034 | 0.39 | 0.18 | 22 | 1000 | 15 | 400 |
| 6 | — | — | 0.033 | 0.0039 | 0.47 | 0.21 | 3 | 1000 | 17 | 350 |
| 7 | — | 0.0011 | 0.024 | 0.0042 | 0.52 | 0.20 | 3 | 1100 | 14 | 300 |
| 8 | — | — | 0.030 | 0.0038 | 0.51 | 0.22 | 3 | 1100 | 22 | 400 |
| 9 | — | — | 0.029 | 0.0035 | 0.51 | 0.20 | 3 | 1100 | 22 | 400 |
| 10 | 0.0020 | — | 0.025 | 0.0045 | 0.51 | 0.20 | 3 | 1100 | 22 | 400 |
| 11 | — | 0.0011 | 0.025 | 0.0024 | 0.51 | 0.20 | 3 | 850 | 16 | 400 |
| 12 | — | 0.0011 | 0.025 | 0.0024 | 0.51 | 0.20 | 3 | 1030 | 3 | 400 |
| 13 | — | 0.0011 | 0.025 | 0.0024 | 0.51 | 0.20 | 3 | 1030 | 16 | 250 |

The "plate cooling rate" in Table 4 is the value of the water cooling rate (35, 20, or 22° C. per second) or air cooling rate (3 or 2° C. per second) of a steel plate after hot rolling measured at the central portion in the thickness direction. The "bent pipe cooling rate" in Table 4 is a value measured in the central portion of the wall thickness direction of the bent pipe. Similarly, the "bent pipe tempering temperature" in Table 4 is a value measured in the central portion of the wall thickness direction of the bent pipe.

The tempering time was calculated based on a rate of one hour per one inch (25.4 mm) of thickness, so it became (60 minutes×16 mm)/25.4 mm=38 minutes. It is desirable to use this rate when manufacturing other thick-walled bent pipes. The reason why it is desirable to prescribe the tempering time in this manner is because if the tempering time is too long, productivity decreases, and a minimum necessary time exists in order to obtain the effect of uniformly tempering the interior. Accordingly, tempering is preferably carried out for at least 0.8 t to at most 1.2 t, wherein t is the holding time calculated from this rate.

The test results for the bend mother pipes and the bent pipes are compiled in Table 5. The values in the two leftmost columns in Table 5 show the results for the bend mother pipes, and all of the other values show results for the bent pipes.

TABLE 5

| | Mother pipe strength | | Side of bend (Base metal) of bent pipe | | | | Weld metal of bent pipe | | HAZ of bent pipe |
|---|---|---|---|---|---|---|---|---|---|
| | TS (MPa) | | YS | TS | YR | Charpy | strength | Charpy | Charpy |
| No. | Base metal | weld metal | (MPa) | (MPa) | (%) | vE−10 (J) | TS (MPa) | vE−10 (J) | vE−10 (J) |
| 1 | 779 | 810 | 758 | 917 | 82.7 | 296 | 943 | 154 | 301 |
| 2 | 985 | 1023 | 767 | 928 | 82.7 | 301 | 1089 | 39 | 321 |
| 3 | 754 | 823 | 742 | 871 | 85.2 | 288 | 882 | 140 | 278 |
| 4 | 839 | 977 | 699 | 797 | 87.7 | 276 | 1003 | 25 | 259 |
| 5 | 646 | 676 | 501 | 625 | 80.2 | 184 | 787 | 161 | 184 |
| 6 | 701 | 743 | 690 | 783 | 88.1 | 222 | 799 | 189 | 232 |
| 7 | 782 | 821 | 784 | 953 | 82.3 | 287 | 968 | 132 | 312 |
| 8 | 812 | 832 | 756 | 911 | 83.0 | 156 | 912 | 101 | 178 |
| 9 | 798 | 833 | 722 | 834 | 86.6 | 201 | 856 | 118 | 182 |
| 10 | 789 | 829 | 733 | 873 | 84.0 | 349 | 892 | 202 | 362 |
| 11 | 782 | 812 | 667 | 778 | 85.7 | 242 | 856 | 182 | 237 |
| 12 | 788 | 822 | 644 | 678 | 95.0 | 164 | 672 | 123 | 224 |
| 13 | 782 | 827 | 671 | 797 | 84.2 | 244 | 844 | 176 | 236 |

Nos. 1, 3, 6, 7, 8, 9, and 10 in Tables 4 and 5 are examples of the present invention. Nos. 2, 4, 5, 11, 12, and 13 in Tables 4 and 5 are comparative examples in which either the composition or the manufacturing conditions deviated from the conditions prescribed in the present invention.

The target for the toughness of the weld metal of the bend portion shown in Table 5 was made the value which is expected to be made the standard for X100 grade which is currently being generally discussed (Charpy absorbed energy at −10° C. of at least 40 J with a shear area of at least 50%).

From the results shown in Table 5, it can be seen that in the examples of the present invention, the strength of the base metal and the weld metal of the bent pipe were higher than the strength of the base metal and the weld metal, respectively, of the bend mother pipe.

It can also be seen from the results shown in Table 5 that in the examples of the present invention, the target performance of at least X100 grade could be fully met, and an ultrahigh strength bent pipe of at least X100 grade could be manufactured with certainty. In contrast, when the conditions prescribed by the present invention were deviated from, the target properties of at least X100 grade could not be satisfied.

What is claimed is:

1. A method of manufacturing a bent pipe comprising preparing a steel plate by air cooling at a cooling rate in the central portion of the thickness direction of the plate of less than 5° C. per second in a temperature range of 700-500° C. after hot rolling, preparing a bend mother pipe in the form of a welded steel pipe from the steel plate, performing hot bending of the bend mother pipe, and then cooling at a cooling rate in the central portion of the thickness direction of at least 5° C. per second in a temperature range of 700-500° C. to manufacture a bent pipe having a base metal with a tensile strength which is higher than the tensile strength of the base metal of the bend mother pipe, wherein the bent pipe has a base metal having a steel composition comprising, in mass %, C:0.03%-0.12%, Si: 0.05%-0.50%, Mn: 1.4%-2.2%, S: at most 0.01%, Mo: 0.05%-1.0%, Al: 0.005%-0.06%, N: at most 0.008%, at least one of Cu: 0.05%-1.0%, Ni: 0.05%-2.0%, and Cr: 0.05%-1.0%, at least one of Nb: 0.005%-0.1%, V: 0.005%-0.1%, and Ti: 0.005%-0.03%, and a remainder of Fe and impurities, with the carbon equivalent Ceq given by the following equation being at least 0.45%:

$$Ceq=C+Mn/6+(Cr+Mo+V)/5+(Cu+Ni)/15.$$

2. A method of manufacturing a bent pipe as set forth in claim 1 wherein the base metal of the bent pipe further contains at most 0.030 mass % of B.

3. A method of manufacturing a bent pipe as set forth in claim 1 wherein the base metal of the bent pipe contains at most 0.005 mass % of Ca.

4. A method of manufacturing a bent pipe comprising preparing a steel plate by cooling after hot rolling at a cooling rate in the central portion of the thickness direction of the plate of less than 5° C. per second in the temperature range of 700-500° C., preparing a bend mother pipe in the form of a welded steel pipe from the steel plate, heating the bend mother pipe to a temperature range of at least 900° C. to at most 1100° C. and performing bending, then cooling the pipe to a temperature range of at most 300° C. at a cooling rate in the central portion of the thickness direction of at least 5° C. per second in a temperature range of 700-500° C., and subjecting the pipe to tempering in a temperature range from at least 300° C. to at most 500° C., wherein the bent pipe has a base metal having a steel composition comprising, in mass %, C:0.03%-0.12%, Si: 0.05%-0.50%, Mn: 1.4%-2.2%, S: at most 0.01%, Mo: 0.05%-1.0%, Al: 0.005%-0.06%, N: at most 0.008%, at least one of Cu: 0.05%-1.0%, Ni: 0.05%-2.0%, and Cr: 0.05%-1.0%, at least one of Nb: 0.005%-0.1%, V: 0.005%-0.1%, and Ti: 0.005%-0.03%, and a remainder of Fe and impurities, with the carbon equivalent Ceq given by the following equation being at least 0.45%:

$$Ceq=C+Mn/6+(Cr+Mo+V)/5+(Cu+Ni)/15.$$

5. A method of manufacturing a bent pipe as set forth in claim 2 wherein the base metal of the bent pipe contains at most 0.005 mass % of Ca.

6. A method of manufacturing a bent pipe as set forth in claim 4 wherein the base metal of the bent pipe further contains at most 0.030 mass % of B.

7. A method of manufacturing a bent pipe as set forth in claim 4 wherein the base metal of the bent pipe contains at most 0.005 mass % of Ca.

8. A method of manufacturing a bent pipe as set forth in claim 6 wherein the base metal of the bent pipe contains at most 0.005 mass % of Ca.

* * * * *